United States Patent [19]

Beres

[11] 4,050,860

[45] Sept. 27, 1977

[54] SPRAY PUMP ASSEMBLY

[75] Inventor: Steve W. Beres, Bridgeport, Conn.

[73] Assignee: VCA Corporation, Baton Rouge, La.

[21] Appl. No.: 691,220

[22] Filed: June 1, 1976

[51] Int. Cl.[2] ..... F04B 21/04

[52] U.S. Cl. ..... 417/444; 222/385; 417/553

[58] Field of Search ..... 417/511, 545–554; 222/321, 385

[56] References Cited

U.S. PATENT DOCUMENTS

| | | | |
|---|---|---|---|
| 3,216,624 | 11/1965 | Corsette | 222/321 |
| 3,724,726 | 4/1973 | Susuki et al. | 222/321 |
| 3,949,910 | 4/1976 | Focht | 222/321 |

*Primary Examiner*—William L. Freeh

*Attorney, Agent, or Firm*—Donald L. Johnson; John F. Sieberth; David L. Ray

[57] ABSTRACT

A finger-operated spray pump assembly adapted to maintain a seal against leakage under substantially all conditions normally encountered by the pump. The assembly includes a compression chamber, a piston slidable in the housing, a grommet for holding the piston in the compression chamber, a stem slidable in the piston, and a seal member abutting the piston. The lower end of the valve stem contacts the seal member to open the seal slightly before the piston starts its downstroke. A closure member for the container to be used is permanently attached to the spray pump.

1 Claim, 9 Drawing Figures

FIG. 1
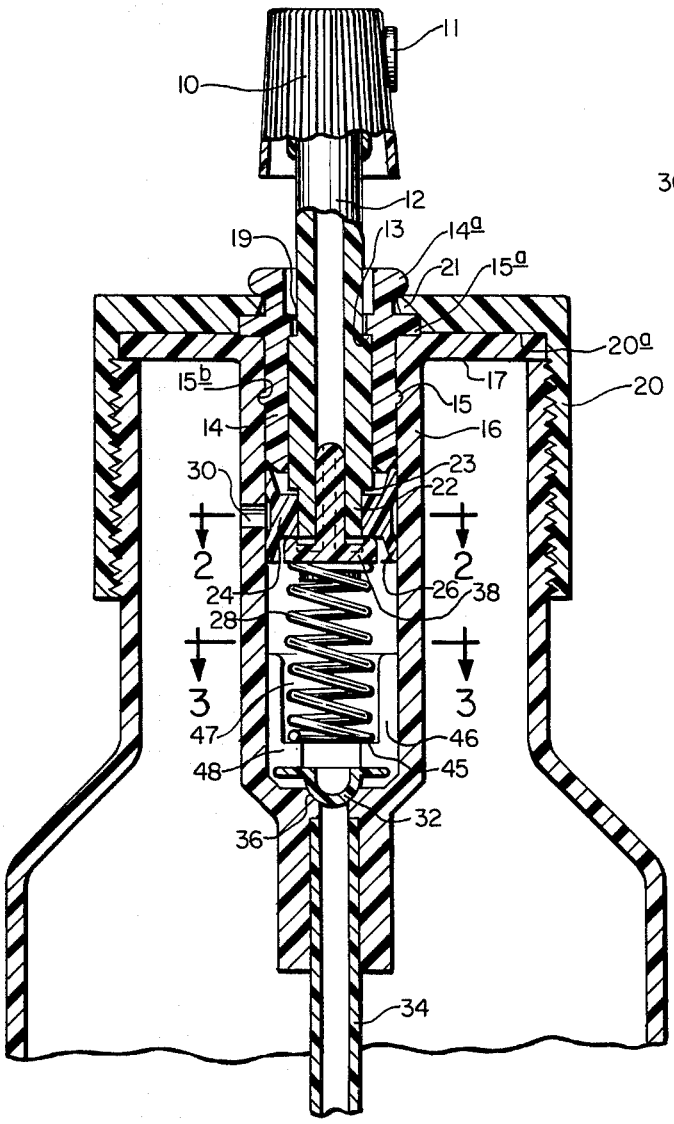
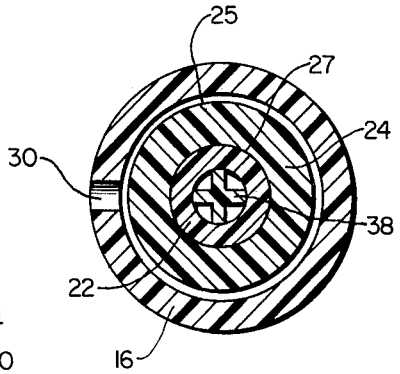
FIG. 2.
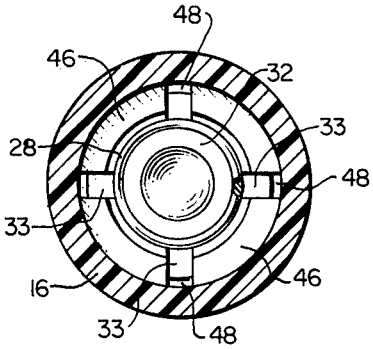
FIG. 3.
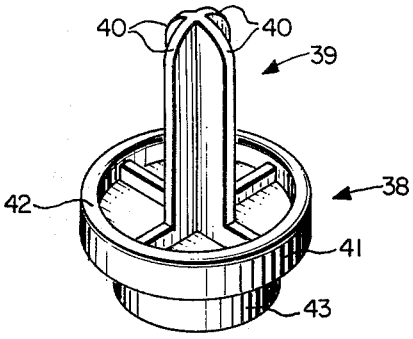
FIG. 4.
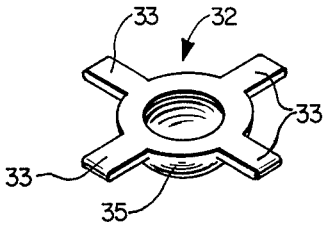
FIG. 5.

SPRAY PUMP ASSEMBLY

BACKGROUND OF THE INVENTION

This invention relates to liquid atomizer pumps. In particular, this invention relates to small hand-held, finger-operated dispensers involving pump assemblages as distinguished from pressurized aerosol containers and valves.

Hand-held atomizer pumps are known in the art, e.g., see U.S. Pat. No. 3,159,316. Among the features that are desirable in a hand-held atomizer pump are that the pump be easily primed, that it provide a leak resistant assembly when attached to a container, particularly when the container is subjected to pressure or is stored on its side or inverted. Further, it is desirable to utilize as few parts as possile in the construction of the pump and to keep the parts relatively simple to achieve low cost for the production and assembly of the pump. Another desirable feature is that the pump be permanently attached to the closure member, i.e., cap or ferrule by the pump manufacturer before shipping the pump to the customer. While some of the prior art pumps may possess some of the desirable features set forth above, no one pump is known to possess all of these features. Thus, it can be readily seen that there is a real need for an improved finger-operated spray pump.

SUMMARY OF THE INVENTION

In accordance with the present invention there is provided a liquid atomizer pump including a compression chamber, a piston slidably located in the compression chamber, a grommet for holding the piston in the compression chamber, a stem slidable in the piston, and a seal member adapted to abut the piston, and a check valve located in the lower end of the cylinder.

BRIEF DESCRIPTION OF THE DRAWINGS

FIG. 1 is an enlarged fragmentary sectional view showing details of the pump;

FIG. 2 is a cross-sectional view taken along lines 2—2 of FIG. 1;

FIG. 3 is a cross-sectional view taken along lines 3—3 of FIG. 1;

FIG. 4 is a perspective view of the seal;

FIG. 5 is a perspective view of the check valve;

DESCRIPTION OF THE PREFERRED EMBODIMENTS

Figure 6:
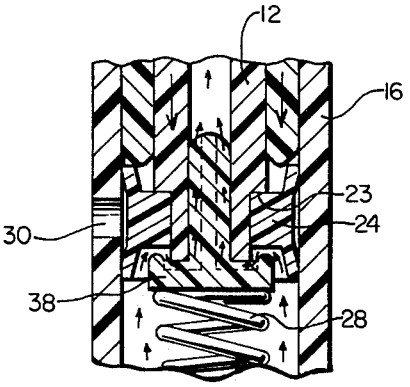
FIG. 6 is a fragmentary sectional view of the pump showing the position of the seal as the actuator button begins moving downwardly.

As is illustrated in FIGS. 1 thru 9, the atomizer pump of the invention includes a compression chamber 16 which has on its upper end an integral flange 17 which is seated on the top of the neck of container 18. A screw cap 20 has its top underside 20*a* in abutment with the top 17*a* of flange 17 and is threadably connected to the neck of container 18.

The screw cap 20 is fixedly attached to the atomizer pump by means of a hollow cylindrical grommet 14 which is sealingly received in the upper end of compression chamber 16 and retained therein by an annular bead 15 received in an annular recess 15*b* in the inner wall of the tank. The grommet is provided with an integral, outwardly projecting, annular collar 15*a* which is received in a recess 15*c* provided in the underside of the cap and top of flange adjacent the central opening in the cap. An outwardly extending locking bead 14*a* is provided at the upper end of the grommet. The locking bead 14*a* has a diameter slightly larger than the central opening in the top of cap 20. When the cap is forced over the locking bead, it is pemanently locked into unitary engagement with the tank, tank flange and grommet. Thus, the pump assembly can be permanently attached to the cap by the pump manufacturer and the entire unit shipped to the customer as a unit which will not come apart during shipment or handling by automated capping machines when the atomizer pump is being attached to the filled container.

Slidably located inside grommet 14 is a hollow stem 12. An annular clearance is provided between the outer wall of the stem and the inner wall of the grommet to permit air to be supplied to the interior of container 18. At the top of stem 12 is a conventional push-button actuator 10 which includes nozzle 11 for atomizing the liquid pumped from the container 18. Stem 12 has a shoulder 13 which contacts a retaining ring 19 located on the inside wall of grommet 14. Retaining ring 19 limits the upward movement of stem 12. The lower end of stem 12 has a reduced diameter outside portion 22. Immediately above section 22 is a shoulder 23 which contacts piston 24 when stem 12 is forced downwardly.

Piston 24 is slidably located inside cylinder 16. As can be seen in FIG. 2, piston 24 is circular in cross-section. Located on the outside of piston 24 is an annular, reduced diameter section 25. Above and below the reduced section 25 are annular increased diameter sections 26 which contact the inner walls of cylinder 16 to insure a sliding pressure seal therewith. The center of piston 24 has a hollow bore 27 for receipt of the lower end 22 of stem 12. The relative diameters of the lower portion 22 of stem 12 and bore 27 of piston 24 is such that the lower portion 22 of stem 12 will slide inside of piston 24 while snuggly fitting therein.

Located adjacent the piston 24 in FIG. 1 is vent hole 30 in the wall of compression chamber 16. Vent hole 30 allows air from outside container 18 to enter the container through the clearance provided between the stem and the grommet when button 10 is depressed.

Slidingly fitted in the lower end of stem 12 is a seal member generally indicated in FIG. 4 by the numeral 38. Seal 38 includes a base 41 which is circular in cross-section and has an upper annular ring portion 42 which contacts the bottom of piston 24 to make a pressure seal with piston 24. At the bottom of seal 38 is a reduced diameter section 43 adapted to receive the upper end of coil spring 28. An integral center post, generally indicated by the numeral 39, projects upwardly from base 41 and has a series of longitudinal projections 40 thereon. In the drawings, four projections are shown although a greater or lesser number may be used.

As can be seen in FIG. 1, one end of coil spring 28 presses against the seal 38 while the other end presses against a plurality of shoulders 45 located inside cylinder 16. Shoulders 45 are located on guides 46 provides on the lower interior surface of compression chamber 16. As can be seen in FIGS. 1 and 3, guides 46 define a hollow cylindrical portion 47 in the lower end of tank 16 into which spring 28 is snuggly received. At the bottom end of guides 46 is a hollow hemispherical portion 48 for the receipt of the hemispherical center 35 of check valve 32. Located between guide portions 46 are slots 48 in which the flanges, or arms, 33 of check valve 32 travel as check valve 32 moves upwardly and downwardly.

The check valve, generally indicated by the numeral 32, can be seen in more detail in FIG. 5. Check valve 32 has a series of flanges or arms 33 thereon which travel in the space between guides 48 as previously mentioned. Also check valve 32 has a rounded or hemispherical center portion 35 for contacting beveled portion 36 at the lower end of compression chamber 16 to form a pressure seal. A conventional ball check valve may be used if desired.

Located below check valve 32 is a dip tube 34 which is connected to the lower end of compression chamber 16. Tube 34 conveys liquids from container 18 to compression chamber 16.

The pump of the present invention is substantially leak-proof when the container is on its side, inverted, or is subjected to above average temperatures. The annular, upper, increased diameter section 26 of the piston is forced into tight, sealing engagement with the bottom of the grommet when the pump is in the inactive position as seen in FIG. 1. The relationship between the length of the lower end 22 of the stem, the location of the shoulder 23 above the top of piston 24, the thickness of the piston and length of the grommet are coordinateed so that spring 28 and seal member 38 force the annular, upper end 26 of the piston to sealing engagement with the lower end of the grommet.

Figure 7:
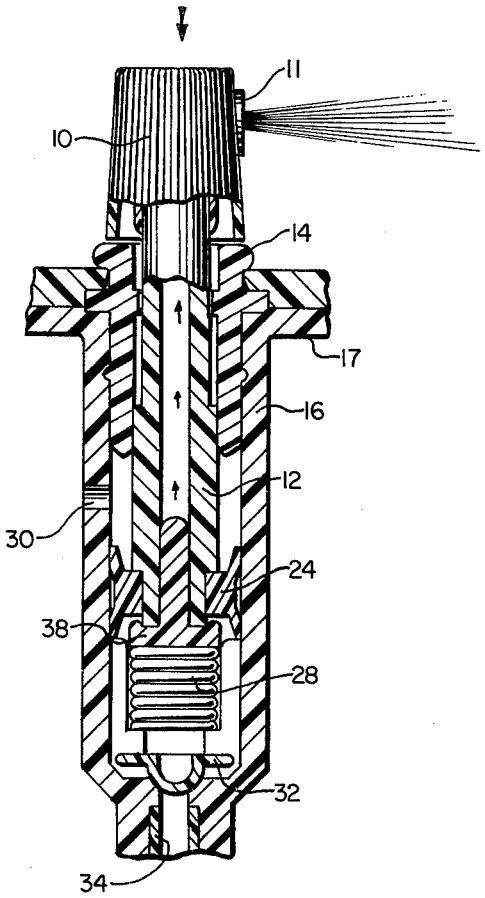
FIG. 7 is a fragmentary, partly-sectional view of the pump showing the actuator button in the fully depressed position.
Figure 8:
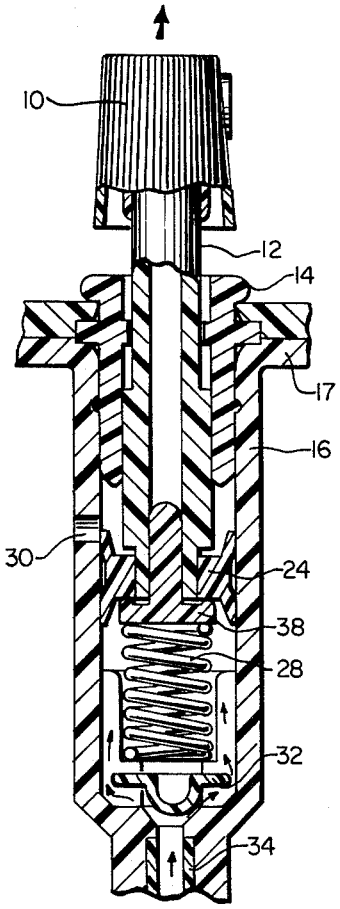
FIG. 8 is a fragmentary, partly-sectional view of the pump when the actuator button begins its upward movement; and, FIG. 9 is a fragmentary, partly-sectional view of an additional embodiment of the present invention.

The operation of the atomizer of the present invention is shown in FIGS. 6 thru 8. As a downward force is applied to actuator 10, stem 12 is forced downwardly an initial distance forcing shoulder 23 to strike the top portion of stationary piston 24 and moves the upper annular ring portion 42 of the seal away from the bottom of piston 24. At this point fluid contained in the tank 16 beneath piston 24 is then free to move in the direction indicated by the arrows in FIG. 6 around seal 38 and upward through stem 12 to nozzle 11. At the position shown in FIG. 6, piston 24 has not been forced downward any distance by stem 12.

In FIG. 7, stem 12 has been forced downward to fully compress spring 28. Valve 32 is closed during the full downward movement of stem 12 due to the pressure on the fluid between piston 24 and valve 32, and fluid flows as shown by the arrows in FIG. 7. During such time that the depressing movement of the piston assemblage occurs, venting is effected, by which air is permitted to enter the container 18 from the exterior of the atomizer in order to replace the liquid which is being discharged. It will be observed in FIG. 7 that piston 24 has been shifted downward to a level below the vent hole 30. In consequence, the vent hole will now have communication with the exterior atmosphere, by virtue of the annular space between the stem 12 and grommet 14. Atmospheric air may enter past such loose fitting parts, into the upper portion of the compression chamber 16 above the piston and thence outward through the vent hole 30 into the interior of the container 18 to relieve the vacuum that is created by displacement of the fluid contents of the container.

In FIG. 8 the atomizer pump is shown immediately after the downward force on actuator 10 has been released. At this point, spring 28 forces the stem 12, piston 24 and seal 38 upward and liquid from container 18 travels upwardly in tube 34. The liquid forces check valve 32 up, flows therearound, and continues upward through channels formed between guides 46 into the space in the tank beneath pistion 24. As soon as the downward force on button 10 is released, spring 28 forces the ring portion 42 of seal 38 into contact with the bottom of piston 24 thereby preventing any fluid from traveling upward into stem 12. After stem 12 has traveled completely upward, the volume beneath piston 24 and above valve 32 will be filled with liquid. Piston 24 will be opposite vent hole 30, and in sealing contact with the bottom of grommet 14 thus blocking the contents of both container 18 and the compression chamber 16 and preventing any liquid from seeping or leaking past the loose fitting stem 12. When button 10 is again depresssed, the fluid within compression chamber 16 will be forced outward through nozzle 11. It is understood that the bottom check valve 32 may be a spherical ball rather than the valve described herein.

Figure 9:
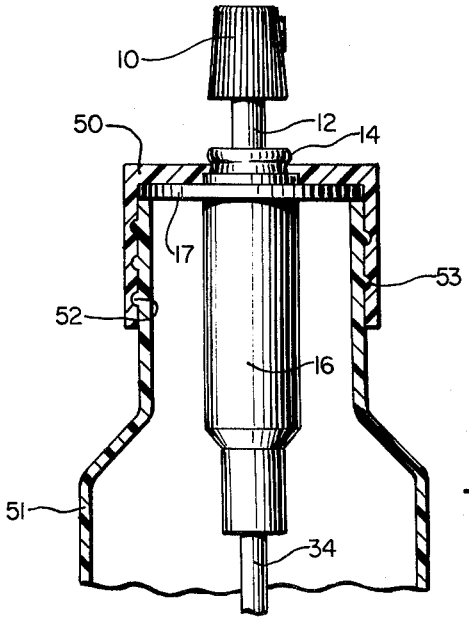

In FIG. 9 of the drawings is shown another embodiment of the atomizer pump of the present invention. Cap 50 is forced onto container 51 and is held in place by an annular rib 52 which is force fitted into a groove 53 and securely holds the cap in place. If desired, groove 53 could be contained on the inside of the neck of the container 51 and cap 50 could be made smaller in diameter with an annular rib on the outside thereof to fit into the internal groove.

What is claimed:

1. A finger-operated spray pump assembly comprising:

a. compression chamber means, said compression chamber means having vent hole means in the wall thereof, and closure means rigidly connectable thereto, the lower end of said compression chamber means having a series of guide means connected to the inside wall thereof;

b. piston means slidably fitted in said compression chamber means;

c. grommet means rigidly connectable to said compression chamber means for connecting closure means to said compression chamber means;

d. hollow stem means having an upper end and a lower end, said upper end of said stem means being slidably fitted inside said grommet means, said stem means having actuator button means connectable to the upper end thereof, said stem means having shoulder means for contacting and forcing said piston means toward said check valve means, and said lower end of said stem means being slidably fitted in said piston means;

e. seal means slidably fitted in said lower end of said stem means, said seal means having base means, said base means having post means connected thereto, said post means being adapted for slidable receipt in said lower end of said stem means, said lower end of said stem means being adapted to urge said seal means away from sealing contact with said pistion means prior to said shoulder means contacting said piston means;

f. spring means fitted inside said compression chamber means to urge said seal means against said piston means;

g. check valve means located in the lower end of said compression chamber means, said check valve means having arm means thereon which are slidably received between said guide means; and, h. dip tube means connectable to said compression chamber means.

* * * * *